US005101212A

United States Patent [19]

Shinnai et al.

[11] Patent Number: 5,101,212

[45] Date of Patent: Mar. 31, 1992

[54] WIDE-BAND ANTENNA ON VEHICLE REAR WINDOW GLASS

[75] Inventors: Masao Shinnai; Kazuya Nishikawa; Tokio Tsukada; Tohru Hirotsu, all of Matsusaka, Japan

[73] Assignee: Central Glass Company, Limited, Japan

[21] Appl. No.: 555,592

[22] Filed: Jul. 23, 1990

[30] Foreign Application Priority Data

Jul. 24, 1989 [JP] Japan ..... 1-190806

[51] Int. Cl.[5] ..... H01Q 1/32

[52] U.S. Cl. ..... 343/713; 343/704

[58] Field of Search ..... 343/713, 704, 711

[56] References Cited

U.S. PATENT DOCUMENTS 4,063,247 12/1977 Sakurai et al. ..... 343/713
4,954,797 9/1990 Shinnai et al. ..... 343/713

FOREIGN PATENT DOCUMENTS 58-96402 6/1983 Japan ..... 343/713
59-13404 1/1984 Japan ..... 343/713
2019100 10/1979 United Kingdom .
2131622 6/1984 United Kingdom .
2184292 6/1987 United Kingdom .

*Primary Examiner*—Michael C. Wimer
*Assistant Examiner*—Hoanganh Le

[57] ABSTRACT

The invention relates to an antenna on a vehicle rear window glass for the reception of FM radio broadcasting and TV broadcasting in both the VHF and UHF bands. The window glass is provided with defogging heater strips, and the antenna uses a space left above the heater strips. The antenna is a combination of a main antenna and a secondary antenna, and every element of the antenna is a conductive strip. The main antenna has at least two horizontally extending primary elements which are parallel to and at a relatively short distance from each other. Each of the primary elements has a length of 300–550 mm and is connected at its one end to the other(s) by a subsidiary element arranged perpendicular to the primary elements. The secondary antenna has a middle part, which is relatively long and extends horizontally, and two extension parts which extend from the two opposite ends of the middle part parallel and close to the two opposite side edges of the window glass, respectively. The middle part is close to the upper edge of the window glass or close to the uppermost heater strip. The secondary antenna is connected to the main antenna by a straight extension of the subsidiary element of the main antenna.

14 Claims, 4 Drawing Sheets

WIDE-BAND ANTENNA ON VEHICLE REAR WINDOW GLASS

BACKGROUND OF THE INVENTION

This invention relates to an antenna provided to a vehicle rear window glass for receiving FM radio and television (TV) broadcast waves, the antenna being made up of conductive strips attached to the window glass by using a space left above the defogging heater strips. The antenna is particularly suited to automobiles.

In recent automobiles there is a trend to adoption of a so-called window glass antenna for receiving radio broadcast waves, and there is an increasing demand for a window glass antenna which can efficiently receive both FM radio broadcast waves and TV broadcast waves. To meet such a demand there are several proposals.

For example, JP-A 61-203702 proposes a windshield antenna comprising, as an essential element, a conductive strip which extends vertically in the middle region of the windshield, and JP-A 61-121603 proposes an automobile rear window glass antenna which is disposed in a space left above an array of defogging heater strips and constructed so as to be able to receive both FM radio broadcast waves and TV broadcast waves.

However, in the case of providing an antenna in the middle region of the windshield it is inevitable that the driver's field of view is obstructed. In the case of a rear window glass antenna only a narrow space above the defogging heater strips is allowed for the antenna, and for this reason it is difficult to construct an antenna which exhibits high reception gains over a wide range of frequency inlcuding the FM radio broadcasting bands and both the VHF and UHF bands for TV broadcasting.

SUMMARY OF THE INVENTION

It is an object of the present invention to provide a vehicle rear window glass antenna, which is suited to automobiles and capable of receiving FM broadcast waves and TV broadcast waves in both the VHF band and the UHF band with sufficiently high gains and can be disposed in a space left above the defogging heater strips provided to the rear window glass.

The present invention provides an antenna attached to a vehicle rear window glass for receiving FM radio broadcast waves and television broadcast waves, the window glass being provided with defogging heater strips which extend horizontally and connect with a pair of bus bars arranged approximately parallel to the two opposite side edges of the window glass. The antenna according to the invention comprises a main antenna and a secondary antenna. The main antenna comprises two primary elements each of which is a conductive strip extending horizontally and having a length in the range from 300 to 550 mm, the primary elements being arranged parallel to each other at a distance shorter than the aforementioned length from each other and located in a space between the uppermost one of the heater strips and the upper edge of the window glass, and a subsidiary element which is a conductive strip extending perpendicular to the primary elements from an end of one of the two primary elements to an end of the other of the primary elements. The secondary antenna is a conductive strip bent so as to comprise a middle part which extends horizontally in the aforementioned space and has a length not shorter than the total length of the two primary elements of the main antenna and two extension parts which extend from the two opposite ends of the middle part approximately parallel to the two opposite side edges of the window glass, respectively, the secondary antenna being arranged such that the extension parts do not intersect the primary elements of the main antenna but intersect suppositional and straight extensions of the primary elements. The antenna further comprises a connective conductive strip which is arranged so as to become a straight extension of the subsidiary element of the main antenna and connects with the middle part of the secondary antenna.

In an antenna according to the invention the main antenna may optionally have at least one additional primary element which is a conductive strip extending parallel to the aforementioned two primary elements and having a length in the range from 300 to 550 mm. In that case the subsidiary element of the main antenna is straightly extend so as to connect each of the additional primary elements at one end there of to the essential two primary elements. Usually it suffices that the main antenna has only two horizontal primary elements. The horizontal and parallel arrangement of at least two primary elements having a specific length is the key to the construction of a window glass antenna high in the reception gains over a wide range of frequency including both the FM radio broadcasting bands and TV broadcasting bands.

As to the secondary antenna, the horizontal middle part is close to the upper edge of the window glass or, alternatively, close to the uppermost one of the heater strips. In the former case each of the two extension parts extends downward and is bent so as to have an end part extending approximately parallel and close to the uppermost heater strip toward a widthwise central region of the window glass or, alternatively, is straightly extended so as to become approximately parallel to one of the bus bars for the heater strips. In the latter case each of the two extension parts extend upward and is bent so as to have an end part extending approximately parallel and close to the upper edge of the window glass toward the central region of the window glass. By the addition of the secondary antenna of such a shape the reception gains of the antenna are further increased.

A vehicle rear window glass antenna according to the invention can be constructed in a relatively narrow area left above the defogging heater strips, and this antenna serves as a wide-band antenna which can receive FM radio broadcast waves, in both the 76–90 MHz band used in Japan and the 88–108 MHz band used in many other countries, and TV broadcast waves in both the VHF band (90–108 MHz and 170–222 MHz) and the UHF band (470–770 MHz) with sufficiently high reception gains. The invention is very suitable for application to automobiles.

DESCRIPTION OF THE PREFERRED EMBODIMENTS

Figure 1:
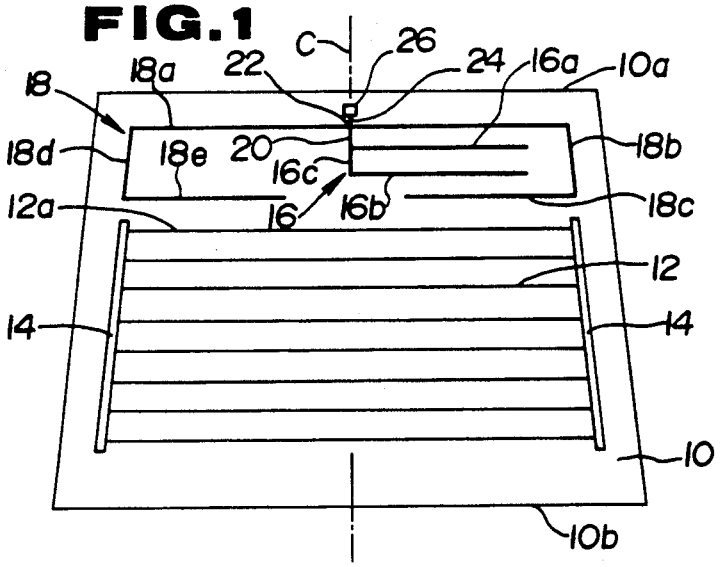
FIG. 1 is a plan view of an automobile rear window glass provided with an antenna according to the invention in a space above defogging heater strips.

FIG. 1 shows an automobile rear window glass in which the present invention is embodied. A single piece of glass plate 10 is used as the window glass. An array of defogging heater strips 12 is disposed on the inboard surface of the window glass 10 so as to leave an open space between the upper edge 10*a* of the glass 10 and the uppermost heater strip 12*a*. The heater strips 12 extend horizontally and connect with a pair of bus bars 14.

Using the open space above the heater strips 12 an antenna according to the invention for the reception of FM radio and TV broadcast waves is disposed on the inboard surface of the window glass 10. The antenna is a combination of a main antenna 16 and a secondary antenna 18, and every element of the antenna is a conductive strip.

The main antenna 16 has two horizontally extending elements 16*a* and 16*b* in a parallel arrangement and a vertical element 16*c* which connects one end of the horizontal element 16*a* to one end of the other horizontal element 16*b*. The two horizontal elements 16*a* and 16*b* have the same length or somewhat different lengths, and the vertical element 16*b* is relatively short compared with the horizontal elements 16*a*, 16*b*. The horizontal elements 16*a*, 16*b* are primary elements of the main antenna 16, and the vertical element 16*c* is a subsidiary element.

The secondary antenna 18 is a conductive strip which is relatively long and bends so as to extend partly horizontally and partly nearly vertically. That is, the secondary antenna 18 has a first part 18*a* which extends horizontally, a second part 18*b* which extends from one end of the first part 18*a* downward approximately parallel to a side edge of the glass 10, a third part 18*c* extending horizontally from the end of the second part toward the widthwise center axis C of the glass 10, a fourth part 18*d* extending from the other end of the first part 18*a* downward approximately parallel to the other side edge of the glass 10 and a fifth part 18*e* extending horizontally from the end of the fourth part 18*d* toward the center axis C. The length of the first part 18*a* of the secondary antenna 18 is greater than the sum of the lengths of the two horizontal elements 16*a*, 16*b* of the main antenna, so that the first part 18*a* extends from a side marginal region of the glass 10 to the opposite side marginal region. The length of the second part 18 is such that the horizontal third part 18*c* extends below the two horizontal elements 16*a* , 16*b* of the main antenna 16. Usually the fourth port 18*d* has the same length as the second part 18*b*. The third and fifth parts 18*c* and 18*e* are each shorter than a half of the first part 18*a* so that a gap exists between these two parts 18*c* and 18*e*. In this embodiment the entirety of the secondary antenna 18 was in the space above the heater strips 12.

The secondary antenna 18 is connected with the main antenna 16 by a conductive strip 20 which extends vertically from a middle point 22 of the first part 18*a* of the secondary antenna to the junction of the horizontal and vertical elements 16*a* and 16*c* of the main antenna. That is, the connection strip 20 is a straight extension of the vertical element 16*c* of the main antenna 16. A short conductive strip 24 extends from the aforementioned point 22 to a feed point 26 of the antenna located between the horizontal part 18*a* of the secondary antenna and the upper edge 10*a* of the window glass 10. In this embodiment, the vertical element 16*c* of the main antenna 16, connection strips 20 and 24 and the feed point 26 are positioned approximately on the center axis C of the window glass 10, and the long horizontal part 18*a* of the secondary antenna 18 is bisected by the center axis C.

Figure 10:
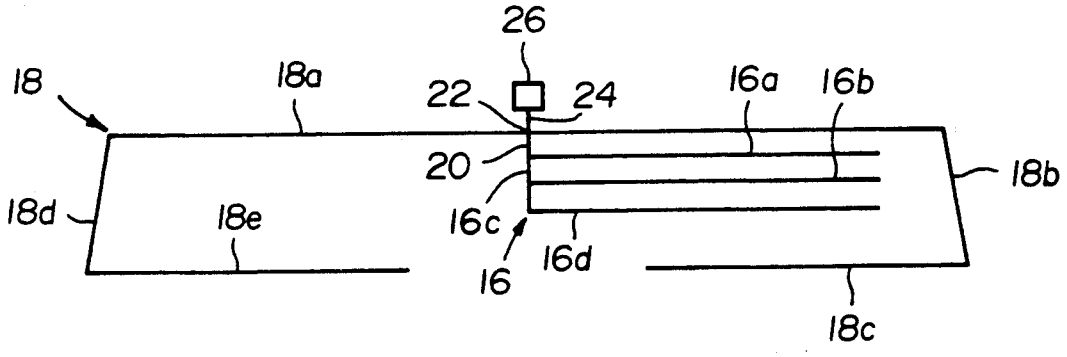
FIG. 10 shows another modification of the antenna.

Usually the heater strips 12, bus bars 14, elements of the main and secondary antennas 16 and 18, feed point 26 and connection lines 20, 24 are formed by printing a conductive paste onto the glass surface and, after drying, baking the glass plate with the printed paste thereon. As mentioned above, the main antenna 16 may have more than two horizontal primary elements. For example, the main antenna 16 of the antenna of FIG. 1 may be modified as shown in FIG. 10 by adding another horizontal primary element 16*d* just below the already described two elements 16*a*, 16*b* and extending the vertical element 16*c* downwardly so as to connect to an end of the additional horizontal element 16*d*.

In a sample of the window glass of FIG. 1, the glass plate 10 was 1170 mm in the length of the upper edge 10*a*, 1460 mm in the length of the lower edge 10*b* and 740 mm in the length perpendicular to the upper and lower edges 10*a*, 10*b*, and the dimensions of the relating to the antenna elements were as follows.

As to the main antenna 16, the two horizontal elements 16*a* and 16*b* were 470 mm and 480 mm long, respectively, and the vertical element 16*c* was 30 mm long. As to the secondary antenna 18: the horizontal upper part 18*a* was 1120 mm long, at a distance of 20 mm from the element 16*a* of the main antenna and at a distance of 30 mm from the upper edge 10*a* of the glass 10; the downwardly extending parts 18*b* and 18*d* were each 90 mm long and the horizontal lower parts 18*c* and 18*e* were each 460 mm long and at a distance of 30 mm from the uppermost heater strip 12*a*.

With this sample, gains of the antenna in receiving FM radio broadcast waves in the 76–108 MHz band, TV broadcast waves of Nos. 1 to 12 channels in the VHF band (90–108 MHz and 170–222 MHz) and TV broadcast waves in the UHF band (470–770 MHz), with respct to horizontally polarized waves, were measured and compared with gains of a standard dipole antenna. That is, for any frequency or channel the gain of the dipole antenna was taken as the basis, 0 dB, and the gain of the sample antenna was marked on this basis. The results are shown in Table 1.

TABLE 1

| FM Radio | | TV (VHF) | | TV (UHF) | |
|---|---|---|---|---|---|
| Frequency (MHz) | Gain (dB) | Channel No. | Gain (dB) | Frequency (MHz) | Gain (dB) |
| 76 | −17.1 | 1 | −13.8 | 470 | −12.4 |
| 80 | −14.0 | 3 | −14.9 | 530 | −18.3 |
| 84 | −13.2 | 4 | −20.2 | 590 | −19.2 |
| 88 | −13.8 | 6 | −19.7 | 650 | −16.2 |
| 90 | −13.5 | 8 | −17.4 | 710 | −15.5 |
| 95 | −14.1 | 10 | −18.9 | 770 | −14.5 |
| 100 | −13.6 | 12 | −19.1 | | |
| 105 | −14.9 | | | | |

TABLE 1-continued

| FM Radio | | TV (VHF) | | TV (UHF) | |
|---|---|---|---|---|---|
| Frequency (MHz) | Gain (dB) | Channel No. | Gain (dB) | Frequency (MHz) | Gain (dB) |
| average | −14.3 | average | −17.7 | average | −16.0 |

Considering that a good example of conventional rear window glass antennas exhibited an average gain (vs. dipole antenna) of about −20 dB in both the FM radio broadcasting band and the VHF band for TV broadcasting and about −18 dB in the UHF band, the rear window glass antenna of FIG. 1 is judged to be a better antenna for the reception of either FM radio broadcast waves or TV broadcast waves in the VHF and UHF bands.

Figure 4:
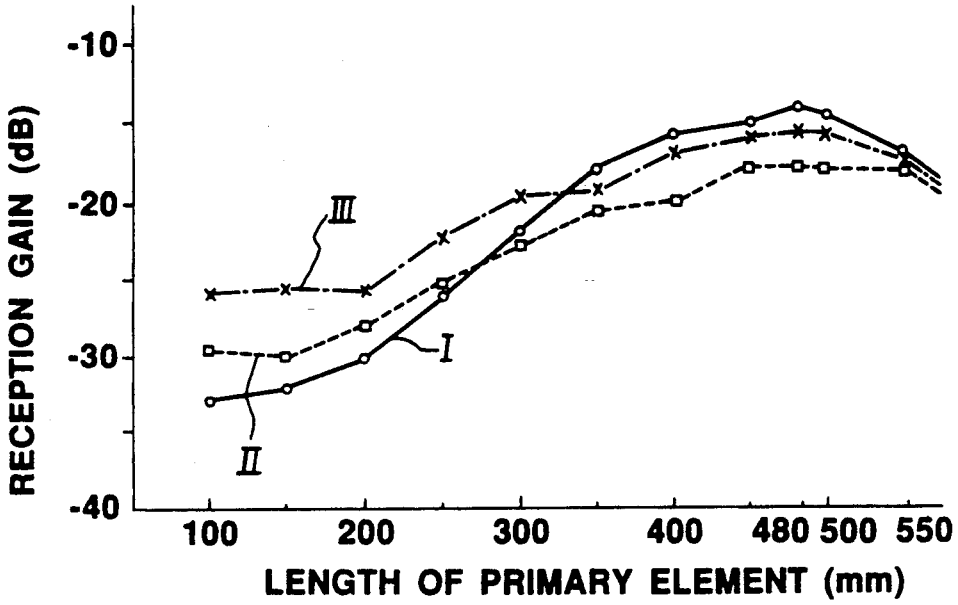
FIG. 4 is a graph showing the relationship between the length of the main antenna elements in the antenna of FIG. 1 and the gains of the antenna in receiving FM radio and TV broadcast waves.

In an antenna according to the invention, each of the horizontal primary elements 16*a*, 16*b* of the main antenna 16 is not shorter than 300 mm and not longer than 550 mm. This limitation is important for realization of high reception gains over the entire range of the FM radio broadcasting band and both the VHF and UHF bands for TV broadcasting. In this regard, FIG. 4 shows the result of an experiment on the aforementioned sample of the window glass antenna of FIG. 1. In the experiment only the length of each of the two primary elements 16*a* and 16*b* was varied from 100 mm to about 600 mm (in every case the two elements 16*a*, 16*b* had the same length), and gains of each sample antenna in receiving FM radio and TV broadcast waves were measured and compared with the gains of the standard dipole antenna. In FIG. 4 the curves I, II and III represent the results for the FM radio broadcasting band (76–108 MHz), VHF TV broadcasting band (90–108, 170–222 MHz) and UHF TV broadcasting band (470–770 MHz), respectively, and the reception gain on the ordinate is an average gain (vs. dipole antenna) in each band. The appropriateness of limiting the length of the primary elements 16*a*, 16*b* in the range from 300 to 550 mm is clearly seen in FIG. 4.

As to the number of the horizontal primary elements (16*a*, 16*b*) of the main antenna 16, another experiment was conducted by using nearly similar samples of the window glass antenna of FIG. 1. In this experiment the length of each of the primary elements (16*a*, 16*b*) of the main antenna 16 was constantly 480 mm, and the dimensions of the other antenna elements were as described hereinbefore. The number of the primary elements (16*a*, 16*b*) of the main antenna 16 was changed to 0, 1, 2, 3 and 4. Reducing the number of the primary elements of the main antenna 16 to 0 means omitting the main antenna 16 to use only the secondary antenna 18. Gains of each sample antenna in receiving FM radio and TV broadcast waves were measured and compared with the gains of the standard dipole antenna. The results are shown in FIG. 5, wherein the curves I, II and III represent average gains (vs. dipole antenna) in the FM radio broadcasting band, VHF TV broadcasting band and UHF TV broadcating band, respectively.

Figure 5:
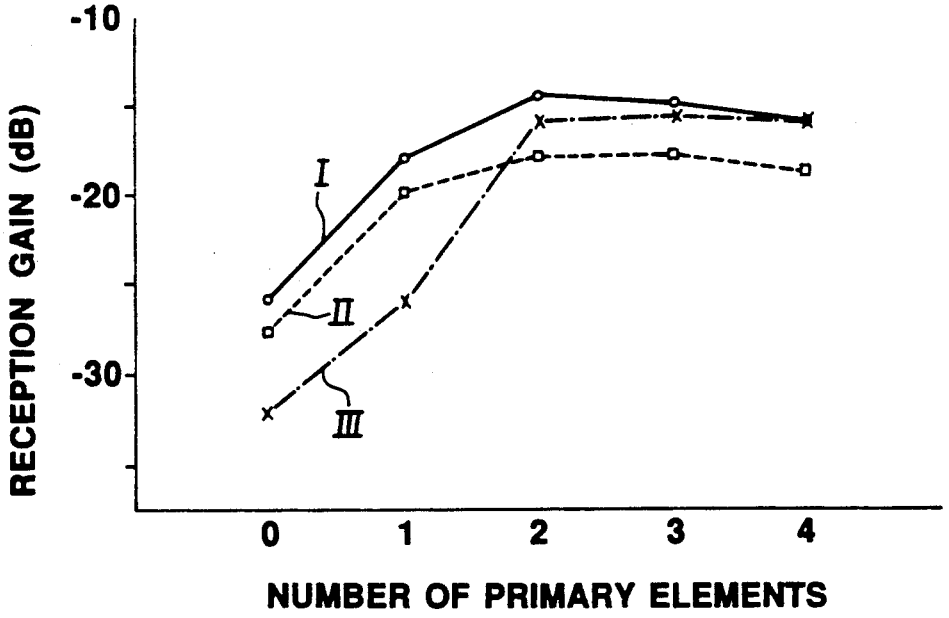
FIG. 5 is a graph showing the relationship between the number of the main antenna elements in an antenna of the type shown in FIG. 1 and the reception gains of the antenna.

As can be seen in FIG. 5, when the secondary antenna 18 alone is used (when the number of the primary elements of the main antenna is 0) the antenna is very low in reception gains for every band and hence is not suitable for practical use. When a main antenna having only one horizontal primary element is added reception gains in every band increases considerably, but the antenna is still unsatisfactory for the reception of TV broadcast waves in the UHF band though it can be used for the reception of FM radio broadcast waves and TV broadcast waves in the VHF band. By employing the main antenna 16 having two parimary elements as shown in FIG. 1 the reception gains further increases in every band so that the antenna becomes fully practicable for the reception of FM radio broadcasting and TV broadcasting in both the VHF and UHF bands. When the number of the primary elements of the main antenna 16 is further increased the reception gains does not significantly increase or decrease.

Figure 2:
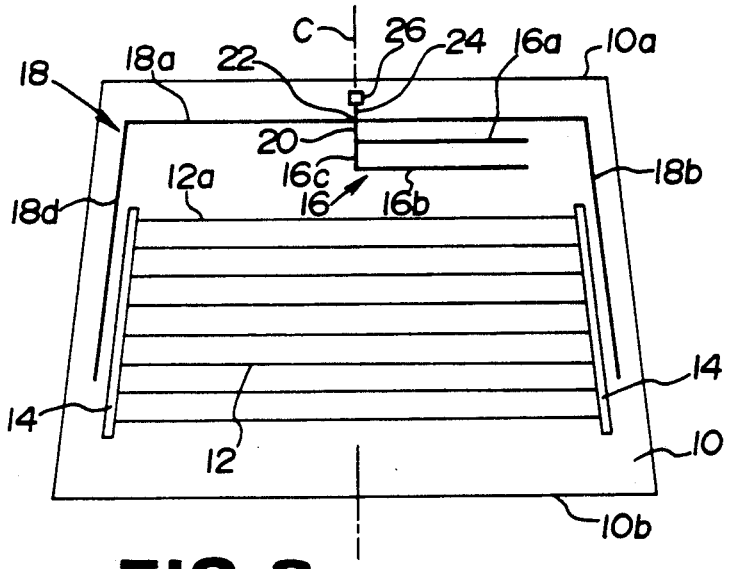
FIGS. 2 and 3 show two different modifications of the antenna in FIG. 1, respectively.

FIG. 2 shows a modification of the window glass antenna shown in FIG. 1 only in respect of the secondary antenna 18. In the embodiment shown in FIG. 2, the horizontal first part 18*a* of the secondary antenna 18 is slightly lengthened, and the second and fourth parts 18*b* and 18*d* are further extended so as to partly extend approximately parallel to the bus bars 14 for the heater strips 12, and the horizontal third and fifth parts (18*c*, 18*e*) shown in FIG. 1 were omitted.

Figure 3:
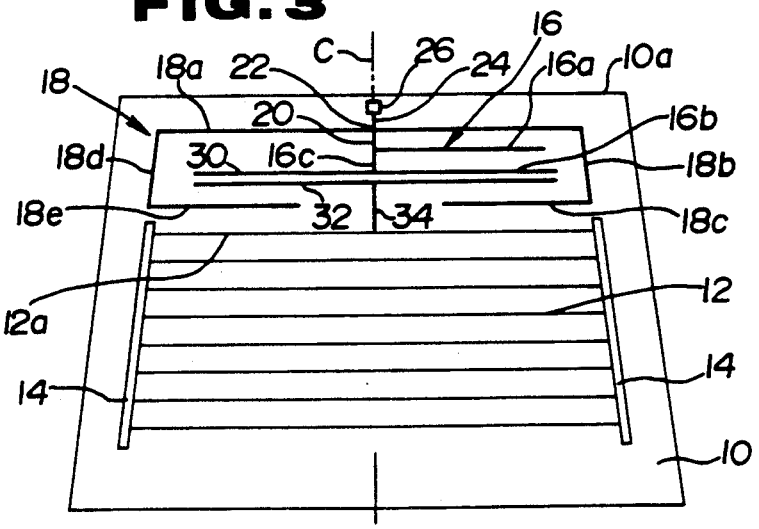

FIG. 3 shows another modification of the window glass antenna shown in FIG. 1. In this case, all the antenna elements in FIG. 1 are left unchanged. In addition, a horizontal conductive strip 30 is provided in the manner of a reverse extension of the horizontal element 16*b* of the main antenna 16, and another horizontal conductive strip 32 is provided so as to extend below and at a short distance from the horizontal strip 30 and the horizontal element 16*b* of the main antenna, and this strip 32 is connected with the uppermost heater strip 12*a* by a conductive strip 34. Since the distance between the conductive strip 32 and either of the conductive strip 30 and the horizontal element 16*b* of the main antenna is very short (only a few millimeters), the main antenna 16 makes capacitive coupling with the heater strips 12.

In a sample of the window glass antenna of FIG. 2 the horizontal first part 18*a* of the secondary antenna 18 was 1130 mm long, and each of the two downwardly extending parts 18*b* and 18*d* was 415 mm long. The dimensions of the glass plate 10 and the other antenna elements were the same as in the sample of the antenna of FIG. 1. In a sample of the window glass antenna of FIG. 3 the horizontal strip 30 was 480 mm long, and the horizontal strip 32 was 960 mm long and at a distance of 5 mm from the conductive strip 30, and the horizontal parts 18*c* and 18*e* of the secondary antenna were each 420 mm long. Otherwise, this sample was similar to the sample of the antenna of FIG. 1. When these sample antennas of FIGS. 2 and 3 were used for the reception of FM radio broadcast waves (76–108 MHz) and TV broadcast waves in the VHF and UHF bands, average gains (vs. the dipole antenna) of the respective sample antennas were as shown in Table 2. From a comparison of Table 2 with Table 1 it is seen that both the antenna of FIG. 2 and the antenna of FIG. 3 are good wide-band antennas comparable to the antenna of FIG. 1.

TABLE 2

| | Average Gain (dB) | | |
|---|---|---|---|
| | FM Radio | TV (VHF) | TV (UHF) |
| Antenna of FIG. 2 | −14.6 | −18.2 | −15.5 |
| Antenna of FIG. 3 | −14.3 | −17.1 | −16.4 |

In the antenna of FIG. 3, the capacitive coupling of the antenna (16+18) with the heater strips 12 is for the purpose of using this antenna also for the reception of AM radio broadcast waves. For the same purpose it is optional to directly connect an according to the invention with the heater strips 12. For example, in the case of the antenna of FIG. 1 the vertical element 16c of the main antenna 16 may be extended downward to connect with the uppermost heater strip 12a, and in the case of the antenna of FIG. 2 either of the downwardly extending parts 18b and 18d of the secondary antenna 18 may be connected with the adjacent bus bar 14.

FIGS. 6 to 9 show still different examples of the arrangement of an antenna according to the invention.

Figure 6:
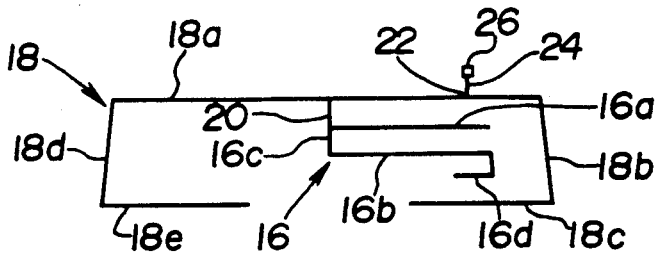
FIGS. 6 to 9 show four different examples of the arrangement of the elements of an antenna according to in invention; and respectively.

The antenna of FIG. 6 differs from the antenna of FIG. 1 in that one (16b) of the horizontal primary elements of the main antenna 16 is bent in an end portion remote from the vertical element 16c so as to form a turn-back part 16d, and that the location of the feed point 26 and the point 22 of connection of the antenna with the feed point 26 are shifted from the widthwise central region of the window glass to a region nearer an end of the horizontal part 18a of the secondary antenna 18.

Figure 7:
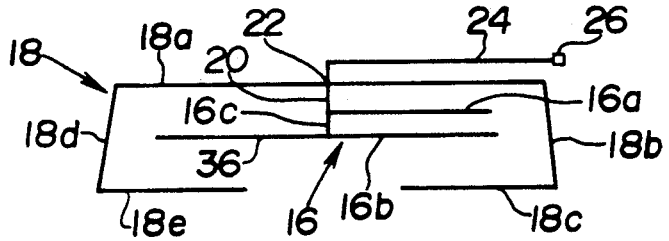

The antenna of FIG. 7 has the main and secondary antenna 16 and 18 shown in FIG. 1 and, in addition, has an impedance matching antenna element 36 which extends horizontally from the lower end of the vertical element 16c of the main antenna in the direction reverse to the horizontal element 16b of the main antenna. As another change, the feed point 26 is located in an upper corner region of the window glass, so that the connection strip 24 is bent and extended horizontally.

Figure 8:
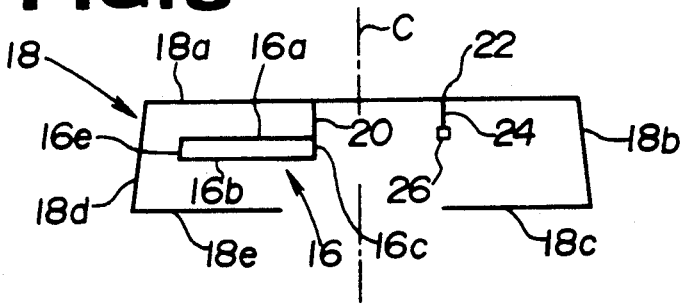

In the antenna of FIG. 8, the main antenna 16 in FIG. 1 is modified by the addition of another vertical element 16e which connects one end of the horizontal element 16a to one end of the horizontal element 16b. That is, in this case the main antenna 16 forms a horizontally elongate rectangle. Besides, the location of the main antenna 16 is somewhat shifted to the left together with the connection strip 20, and the location of the feed point 26 is somewhat shifted to the right and downward.

Figure 9:
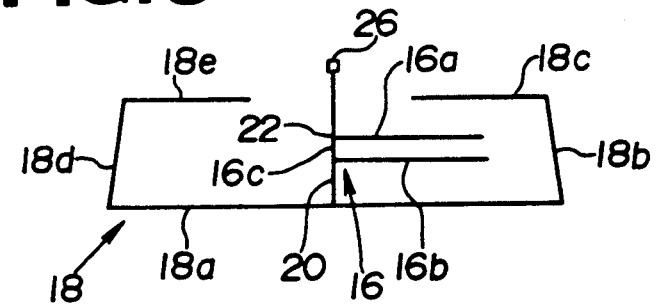

In the antenna of FIG. 9, the secondary antenna 18 in FIG. 1 is rotated by 180° without changing the arrangement of the main antenna 16. That is, in this antenna the long horizontal part 18a of the secondary antenna 18 extends below the main antenna 16, and the shorter horizontal parts 18c and 18e of the secondary element 18 extend at a short distance from the upper edge 10a (not shown in FIG. 9) of the window glass. In the antenna of FIG. 9 the main antenna 16 is directly connected to the feed point 26 by a connection strip 24.

Any of the antennas of FIGS. 6 to 9 is equivalent or nearly equivalent to the antenna of FIG. 1 in the efficiencies of receiving FM radio broadcasting and TV broadcasting in both the VHF and UHF bands.

As to the location of the main antenna 16 of an antenna according to the invention, it is preferable that the horizontal primary elements 16a, 16b extend from a widthwise central region of the window glass 10 toward a side edge of the glass, as illustrated in FIGS. 1-3, 6, 7 and 9. In other words, it is preferable that the vertical element 16c of the main antenna extends approximately on the center axis C of the window glass 10. However, it is also possible to arrange the main antenna 16 such that the horizontal elements 16a, 16b are distant from the center axis C as in the example of FIG. 8 or such that the horizontal elements 16a, 16b crosswise intersect the center axis C. The distance between the two horizontal elements 16a and 16b of the main antenna 16 is not strictly limited, but preferably the distance is from 5 to 100 mm. The same applies to the distance between two adjacent horizontal elements of the main antenna having three or more horizontal elements.

As to the secondary antenna 18, it is favorable for increasing the reception gains to extend the long horizontal part 18a above the main antenna 16 and at a short distance from the upper edge 10a of the window glass 10, though it is also possible to extend the long horizontal part 18a below the main antenna 16 (as shown in FIG. 9) and at a short distance from the uppermost heater strip 12a. When the secondary antenna 18 has shorter horizontal parts 18c and 18e at a relatively short distance from the uppermost heater strip 12a, as shown in FIG. 1, it is preferable that each of these horizontal parts 18c and 18e has a length not shorter than ¼ of the length of the uppermost heater strip 12a. When the horizontal parts 18c and 18d extend at a short distance from the upper edge 10a of the window glass, as shown in FIG. 9, it is preferable that each of these horizontal elements 18c and 18e has a length not shorter than ¼ of the length of the upper edge 10a of the glass 10. When the secondary antenna 18 does not have the shorter horizontal parts 18c, 18e as in the case of FIG. 2, it is preferable that each of the downwardly extending parts 18b and 18d is approximately parallel to one of the bus bars 14 over a length not shorter than ⅔ of each bus bar 14.

Preferably the feed point 26 and the point 22 of connection of the antenna with the feed point 26 are located in the widthwise central region of the window glass 10, i.e. approximately on the center axis C. However, when such arrangement is difficult or inconvenient according to the type of the vehicle it is possible to locate the feed point 26 in a different region as shown, for example, in FIG. 6, 7 or 8, and the position of the connection point 22 too may be changed according to the need.

It is optional to add an impedance matching antenna element such as, for example, the element 36 in FIG. 7 or an auxiliary antenna element for a different purpose such as an antenna element for improving directional characteristics of the antenna. Also it is optional, and rather preferable, to construct a diversity antenna system for the reception of FM radio broadcasting and TV broadcasting by combining an antenna according to the invention with another glass antenna provided to the vehicle rear window glass by utilizing the space below the heater strips and/or a conventional antenna such as a pole antenna.

What is claimed is:

1. An antenna attached to a vehicle rear window glass for receiving FM radio broadcast waves and television broadcast waves, the window glass being provided with defogging heater strips which extend horizontally and connect with a pair of bus bars arranged approximately parallel to two opposite side edges of the window glass, respectively, the antenna comprising:

a main antenna comprising two primary elements each of which is a conductive strip extending horizontally and having a length in the range from 300 to 550 mm, said primary elements being arranged parallel to each other at a distance shorter than said length from each other and in a space between an uppermost one of the heater strips and an upper edge of the window glass, and a subsidiary element which is a conductive strip extending perpendicular to said primary elements from an end of one of said primary elements to an end of the other of said primary elements, said subsidiary element being located in a widthwise central region of the window glass;

a secondary antenna which is a conductive strip bent so as to comprise a middle part, located between said primary elements of said main antenna and the upper edge of the window glass, which extends horizontally in said space and has a length not shorter than the total length of said two primary elements of said main antenna and two extension parts which extend downward from the two opposite ends of said middle part approximately parallel to one of said bus bars over a length not shorter than $\frac{2}{3}$ of the length of each bus bar and to the two opposite side edges of the window glass, respectively, said two extension parts not connecting with either of said bus bars, the secondary antenna being arranged such that said extension parts do not intersect said primary elements of said main antenna but intersect suppositional and straight extensions of said primary element;

a connective conductive strip which is arranged so as to become a straight extension of said subsidiary element of said main antenna and connects with said middle part of said secondary antenna; and a feed point disposed in said space and located between said middle part of said secondary antenna and the upper edge of the window glass, said secondary antenna being connected to said feed point at a middle point of said middle part.

2. An antenna according to claim 1, wherein the distance between said two primary elements is in the range from 5 to 100 mm.

3. An antenna according to claim 1, wherein said subsidiary element of said main antenna is at substantially equal distances from the two opposite side edges of the window glass.

4. An antenna attached to a vehicle rear window glass for receiving FM radio broadcast waves and television broadcast waves, the window glass being provided with defogging heater strips which extend horizontally and connect with a pair of bus bars arranged approximately parallel to two opposite side edges of the window glass, respectively, the antenna comprising:

a main antenna comprising two primary elements each of which is a conductive strip extending horizontally and having a length in the range from 300 to 550 mm, said primary elements being arranged parallel to each other at a distance shorter than said length from each other and located in a space between an uppermost one of the heater strips and an upper edge of the window glass, and a subsidiary element which is a conductive strip extending perpendicular to said primary elements from an end of one of said primary elements to an end of the other of said primary elements;

a secondary antenna which is a conductive strip bent so as to comprise a middle part which extends horizontally in said space and has a length not shorter than the total length of said two primary elements of said main antenna and two extension parts which extend from the two opposite ends of said middle part approximately parallel to the two opposite side edges of the window glass, respectively, the secondary antenna being arranged such that said extension parts do not intersect said primary elements of said main antenna but intersect suppositional and straight extensions of said primary element;

a connective conductive strip which is arranged so as to become a straight extension of said subsidiary element of said main antenna and connects with said middle part of said secondary antenna; and a feed point disposed in said space, said secondary antenna being connected to said feed point at a middle point of said middle part, wherein said middle part of said secondary antenna is located between said primary elements of said main antenna and the upper edge of the window glass, and each of said two extension parts of said secondary antenna extends downward from said middle part and is bent so as to have an end part which extends above the uppermost one of the heater strips horizontally toward a widthwise central region of the window glass.

5. An antenna according to claim 4, wherein the length of said end part is not shorter than $\frac{1}{4}$ of the length of the uppermost one of the heater strips.

6. An antenna according to claim 4, wherein said subsidiary element of said main antenna is located in a widthwise central region of the window glass.

7. An antenna according to claim 6, wherein said subsidiary element of said main antenna is at substantially equal distances from the two opposite side edges of the window glass.

8. An antenna according to claim 4, wherein said main antenna further comprises at least one additional primary element which is a conductive strip extending parallel to said two primary elements and having a length in the range from 300 to 550 mm, said subsidiary element being straightly extended so as to connect each of said at least one additional primary element at one end thereof to said two primary elements.

9. An antenna according to claim 4, wherein at least one of said two primary elements of said main antenna is bent in an end portion thereof so as to have a turnback part extending horizontally.

10. An antenna according to claim 4, wherein said main antenna further comprises a supplementary element which is a conductive strip connecting said two primary elements to each other at their ends remote from said subsidiary element.

11. An antenna according to claim 4, wherein the distance between said two primary elements is in the range from 5 to 100 mm.

12. An antenna according to claim 4, wherein the window glass is an automobile rear window glass.

13. An antenna attached to a vehicle rear window glass for receiving FM radio broadcast waves and television broadcast waves, the window glass being provided with defogging heater strips which extend horizontally and connect with a pair of bus bars arranged approximately parallel to two opposite side edges of the window glass, respectively, the antenna comprising:

a main antenna comprising two primary elements each of which is a conductive strip extending horizontally and having a length in the range from 300 to 550 mm, said primary elements being arranged parallel to each other at a distance shorter than said length from each other and located in a space between an uppermost one of the heater strips and an upper edge of the window glass, and a subsidiary element which is a conductive strip extending perpendicular to said primary elements from an end of one of said primary elements to an end of the other of said primary elements;

a secondary antenna which is a conductive strip bent so as to comprise a middle part which extends horizontally in said space and has a length not shorter than the total length of said two primary elements of said main antenna and two extension parts which extend from the two opposite ends of said middle part approximately parallel to the two opposite side edges of the window glass, respectively, the secondary antenna being arranged such that said extension parts do not intersect said primary elements of said main antenna but intersect suppositional and straight extensions of said primary element;

a connective conductive strip which is arranged so as to become a straight extension of said subsidiary element of said main antenna and connects with said middle part of said secondary antenna; and a feed point disposed in said space, said secondary antenna being connected to said feed point at a middle point of said middle part, wherein said middle part of said secondary antenna is located between said primary elements of said main antenna and the uppermost one of the heater strips, each of said two extension parts of said secondary antenna extending upward from said middle part and being bent so as to have an end part which extends approximately parallel to the upper edge of the window glass toward a widthwise central region of the window glass.

14. An antenna according to claim 13, wherein the length of said end part is not shorter than ¼ of the length of the upper edge of the window glass.

* * * * *